US011208869B2

(12) United States Patent
Roane et al.

(10) Patent No.: US 11,208,869 B2
(45) Date of Patent: Dec. 28, 2021

(54) STATIC PACKER PLUG

(71) Applicant: Halliburton Energy Services, Inc., Houston, TX (US)

(72) Inventors: Thomas Owen Roane, Alvord, TX (US); Antonio Rosas, Mesquite, TX (US); Zheng Guan, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 167 days.

(21) Appl. No.: 16/539,188

(22) Filed: Aug. 13, 2019

(65) Prior Publication Data

US 2020/0123874 A1 Apr. 23, 2020

(51) Int. Cl.

| | |
|---|---|
| ***E21B 34/08*** | (2006.01) |
| ***E21B 33/12*** | (2006.01) |
| ***E21B 43/26*** | (2006.01) |
| ***E21B 34/06*** | (2006.01) |
| *E21B 43/14* | (2006.01) |

(52) U.S. Cl.

CPC ..... *E21B 34/08* (2013.01); *E21B 33/12* (2013.01); *E21B 34/063* (2013.01); *E21B 43/26* (2013.01); *E21B 43/14* (2013.01); *E21B 2200/04* (2020.05)

(58) Field of Classification Search

CPC ..... E21B 34/08; E21B 33/12; E21B 43/26; E21B 34/063; E21B 2200/04; E21B 43/14

See application file for complete search history.

(56) References Cited

U.S. PATENT DOCUMENTS

| | | | | |
|---|---|---|---|---|
| 3,455,387 | A * | 7/1969 | Peters | E21B 43/02 166/278 |
| 3,503,445 | A * | 3/1970 | Cochrum | E21B 21/103 166/244.1 |
| 4,050,516 | A | 9/1977 | Canterbury | |
| 4,314,608 | A * | 2/1982 | Richardson | E21B 33/12 166/133 |
| 4,605,074 | A | 8/1986 | Barfield | |
| 5,012,867 | A * | 5/1991 | Kilgore | E21B 23/02 137/454.2 |
| 5,318,117 | A | 6/1994 | Echols, III et al. | |
| 7,322,416 | B2 | 1/2008 | Burris, II et al. | |
| 9,091,134 | B2 | 7/2015 | Vick | |
| 9,151,148 | B2 | 10/2015 | Themig et al. | |

(Continued)

*Primary Examiner* — Steven A MacDonald

(74) *Attorney, Agent, or Firm* — Scott Richardson; Parker Justiss, P.C.

(57) ABSTRACT

Provided is a packer plug. The packer plug, in this example, may include an engagement member having a no go feature configured to engage a no go shoulder of an associated packer assembly. The packer plug, in the example, further includes a nose cone having one or more nose cone openings coupled proximate a downhole end of the engagement member, and a check valve coupled proximate the engagement member. The check valve, engagement member, and nose cone, in this example, create a fluid path between a lower end and an upper end of the packer plug. Further to this example, the check valve is configured to allow downhole fluid to pass uphole through the fluid path as the packer plug is being pushed downhole, but substantially prevent uphole fluid from passing downhole through the fluid path as the packer plug is being pulled uphole.

23 Claims, 5 Drawing Sheets

(56) References Cited

U.S. PATENT DOCUMENTS

| | | | | |
|---|---|---|---|---|
| 9,243,471 | B2 | 1/2016 | Bisset et al. | |
| 9,546,535 | B2 | 1/2017 | Hayter et al. | |
| 2010/0319924 | A1* | 12/2010 | Mahmoud | E21B 43/123 166/325 |
| 2013/0112435 | A1* | 5/2013 | Fleming | E21B 23/006 166/386 |
| 2013/0112436 | A1* | 5/2013 | Fleming | E21B 43/26 166/386 |
| 2013/0133876 | A1 | 5/2013 | Naedler et al. | |

* cited by examiner

STATIC PACKER PLUG

CROSS-REFERENCE TO RELATED APPLICATION

This application claims priority to International Application Serial No. PCT/US2018/057057 filed on Oct. 23, 2018, and entitled "STATIC PACKER PLUG," is commonly assigned with this application and incorporated herein by reference.

BACKGROUND

The process of fracking, also known as induced hydraulic fracturing, involves mixing sand and chemicals in water to form a frac fluid and injecting the frac fluid at a high pressure into a wellbore. Small fractures are formed, allowing fluids, such as gas, petroleum, and brine water, to migrate into the wellbore for harvesting. Once the pressure is removed to equilibrium, the sand or other particle holds the fractures open. Fracking is a type of well stimulation, whereby the fluid removal is enhanced, and well productivity is increased.

Multi-stage hydraulic fracturing is an advancement to harvest fluids along a single wellbore or fracturing string. The fracturing string, vertical or horizontal, passes through different geological zones. Some zones do not require harvesting because the natural resources are not located in those zones. These zones can be isolated so that there is no fracking action in these empty zones. Other zones have the natural resources, and the portions of the fracturing string in these zones are used to harvest from these productive zones.

In a multi-stage fracturing process, instead of alternating between drilling deeper and fracking, a system of frac sleeves (e.g., ball-drop) and packers are installed within a wellbore to form the fracturing string. The sleeves and packers are positioned within zones of the wellbore. Fracking can be performed in stages by selectively activating sleeves and packers, isolating particular zones. Each target zone can be tracked stage by stage, for example by sealing off one zone from another, and then perforating/fracturing, without the interruption of drilling more between stages.

What are needed in the art are improved apparatus, systems, and methods for perforating/fracturing multi-stage zones.

BRIEF DESCRIPTION

Reference is now made to the following descriptions taken in conjunction with the accompanying drawings, in which.

DETAILED DESCRIPTION

Figure 1:
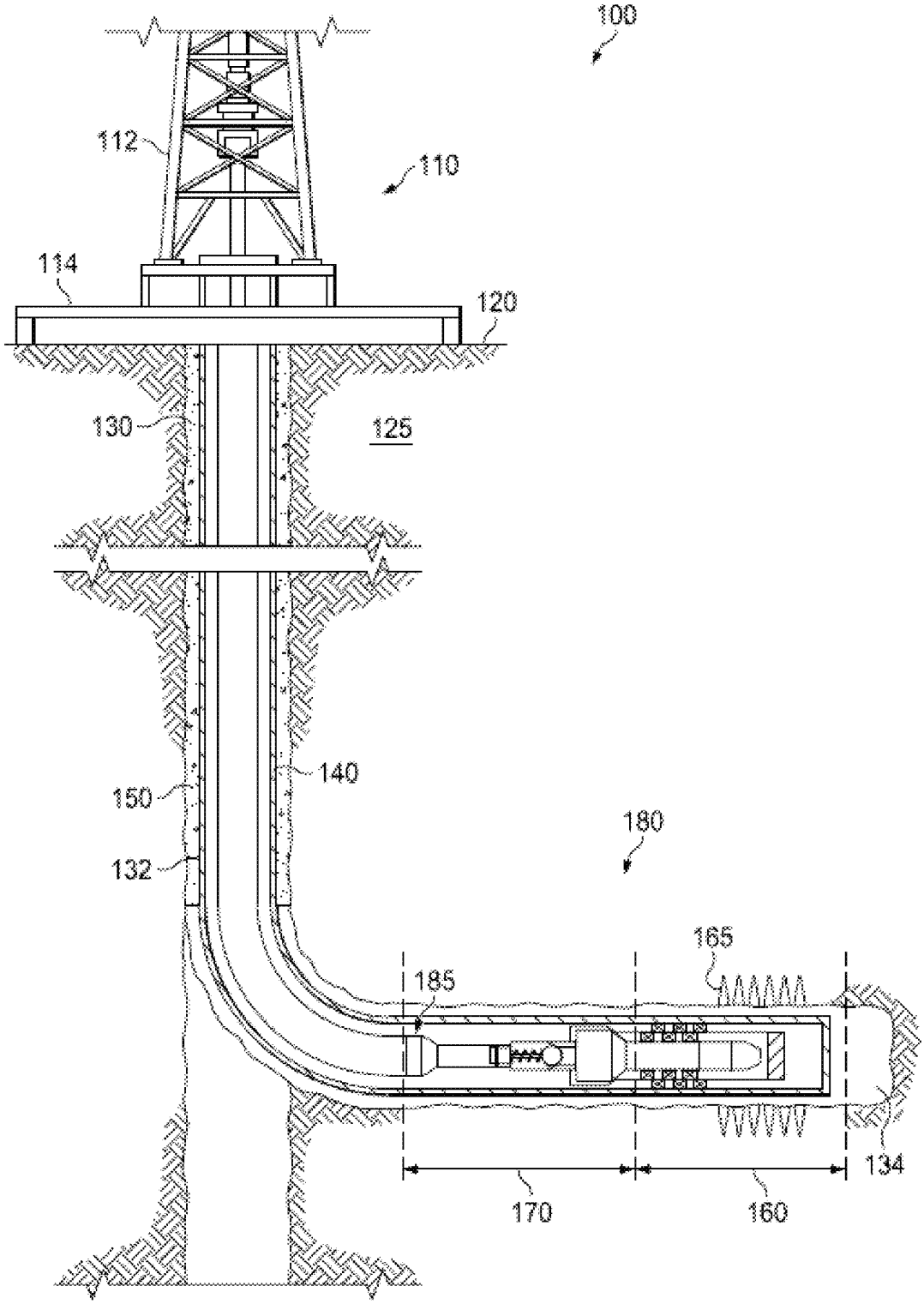
FIG. 1 illustrates a well system including an exemplary operating environment in accordance with the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

Referring to FIG. 1, depicted is a well system 100 including an exemplary operating environment that the apparatuses, systems and methods disclosed herein may be employed. Unless otherwise stated, the horizontal, vertical, or deviated nature of any figure is not to be construed as limiting the wellbore to any particular configuration. As depicted, the well system 100 may suitably comprise a drilling rig 110 positioned on the earth's surface 120 and extending over and around a wellbore 130 penetrating a subterranean formation 125 for the purpose of recovering hydrocarbons and the such. The wellbore 130 may be drilled into the subterranean formation 125 using any suitable drilling technique. In an embodiment, the drilling rig 110 comprises a derrick 112 with a rig floor 114. The drilling rig 110 may be conventional and may comprise a motor driven winch and/or other associated equipment for extending a work string, a casing string, or both into the wellbore 130.

In an embodiment, the wellbore 130 may extend substantially vertically away from the earth's surface 120 over a vertical wellbore portion 132, or may deviate at any angle from the earth's surface 120 over a deviated or horizontal wellbore portion 134. In an embodiment, the wellbore 130 may comprise one or more deviated or horizontal wellbore portions 134. In alternative operating environments, portions or substantially all of the wellbore 130 may be vertical, deviated, horizontal, and/or curved. The wellbore 130, in this embodiment, includes a casing string 140. In the embodiment of FIG. 1, the casing string 140 is secured into position in the subterranean formation 125 in a conventional manner using cement 150.

In accordance with the disclosure, the well system 100 includes one or more fracturing zones. While only two fracturing zones (e.g., a lower fracturing zone 160 and upper fracturing zone 170) are illustrated in FIG. 1, and it is further illustrated that the two fracturing zones are located in a horizontal section 134 of the wellbore 130, it should be understood that the number of fracturing zones for a given well system 100 is almost limitless, and the location of the fracturing zones should not be limited to horizontal portions 134 of the wellbore 130. In the embodiment of FIG. 1, the lower fracturing zone 160 has already been fractured, as illustrated by the fractures 165 therein. In contrast, the upper fracturing zone 170 has not been fractured, but in this embodiment is substantially ready for perforating and/or fracturing. Fracturing zones, such as those in FIG. 1, may vary is depth, length (e.g., 30-150 meters in certain situations), diameter, etc., and remain within the scope of the present disclosure.

The well system 100 of the embodiment of FIG. 1 further includes a service tool assembly 180 manufactured in accordance with this disclosure positioned in and around (e.g., in one embodiment at least partially between) the lower fracturing zone 160 and upper fracturing zone 170. Again, while the service tool assembly 180 is positioned in a horizontal section 134 of the wellbore 130 in the embodiment of FIG. 1, other embodiments exist wherein the service tool assembly 180 is positioned in a vertical 132 or deviated section of the wellbore 130 and remain within the scope of the disclosure. In the embodiment of FIG. 1, the service tool assembly 180, with the assistance of other fracturing apparatuses (e.g., an upper zone packer assembly 185 and a lower zone packer assembly), is configured to substantially if not completely isolate the upper fracturing zone 170 from the lower fracturing zone 160. By isolating the upper fracturing zone 170 from the lower fracturing zone 160 during the fracturing process, the upper fracturing zone 170 may be more easily perforated and/or fractured. Additionally, the isolation may protect the lower fracturing zone (and more particularly the fluid loss device of the lower fracturing zone 160) from the perforating and/or fracturing process.

In accordance with the disclosure, the service tool assembly 180 includes a lower packer assembly, as well as a packer plug positioned within the lower packer assembly. In accordance with the disclosure, the packer plug includes a check valve for allowing fluid to pass uphole from the lower packer assembly and through the packer plug as the packer plug is being pushed downhole. The check valve, however, substantially prevents fluid from entering the lower packer assembly as the packer plug is being pulled uphole.

The present disclosure has recognized that by including the check valve with the packer plug, any excess fluid existing between the packer plug and the lower packer assembly may exit the lower packer assembly as the packer plug is positioned therein. As no excess fluid exists between the packer plug and the lower packer assembly, the packer plug may physically rest upon a no go shoulder of the lower packer assembly. Accordingly, when a perforating device is discharged uphole of the packer plug during the fracturing process, any force created by a compression wave resulting therefrom will transfer directly between the packer plug and the lower packer assembly. Moreover, since the packer plug physically rests on the lower packer assembly, the force of the compression wave cannot compress the fluid located there between, and thus does not damage the fluid loss device located directly there below.

While the well system 100 depicted in FIG. 1 illustrates a stationary drilling rig 110, one of ordinary skill in the art will readily appreciate that mobile workover rigs, wellbore servicing units (e.g., coiled tubing units), and the like may be similarly employed. Further, while the well system 100 depicted in FIG. 1 refers to a wellbore penetrating the earth's surface on dry land, it should be understood that one or more of the apparatuses, systems and methods illustrated herein may alternatively be employed in other operational environments, such as within an offshore wellbore operational environment for example, a wellbore penetrating subterranean formation beneath a body of water.

Figure 2:
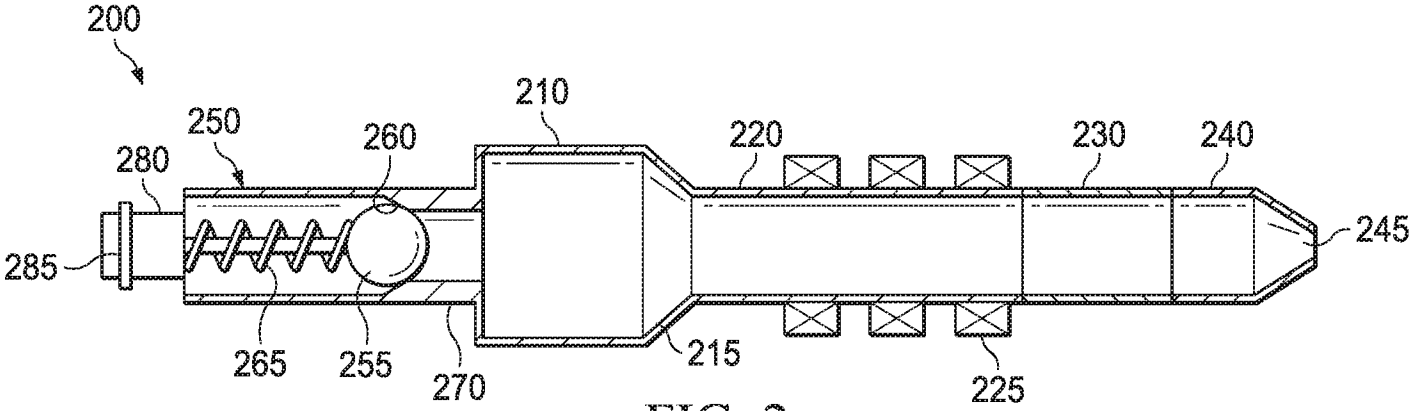
FIG. 2 illustrates one embodiment of a packer plug as might be used with the well system of FIG. 1.

Turning to FIG. 2, illustrated is one embodiment of a packer plug 200 as might be part of the service tool assembly 180 used with the well system 100 of FIG. 1. The packer plug 200 illustrated in FIG. 1, initially includes an engagement member 210. The engagement member 210, in accordance with the disclosure, is configured to engage with an associated lower packer assembly (e.g., one or more no go shoulders of the lower packer assembly in one configuration) as the packer plug 200 is being pushed downhole into the lower packer assembly. In the particular embodiment of FIG. 2, the engagement member 210 includes its own no go features 215, which in turn would engage with the one or more no go shoulders of the associated lower packer assembly.

The packer plug 200 of the embodiment of FIG. 2 further includes a seal assembly 220 coupled proximate a downhole end thereof. The seal assembly 220, in one embodiment, includes one or more sump seals 225. While a particular seal assembly 220 and sump seals 225 have been illustrated in FIG. 2, those skilled in the art understand that various other seal assemblies may be used and remain within the scope of the disclosure.

The packer plug 200, in this embodiment, further including a pup joint 230 coupled to the seal assembly 220. The packer plug 200 additionally includes a nose cone 240, the nose cone having a nose cone opening 245 therein. The nose cone 240 and nose cone openings 245 are configured to allow fluid to pass uphole through the packer plug 200. For example, as the packer plug 200 is pushed downhole into the lower packer assembly, any excess fluid trapped between the two may enter the nose cone 240 through the nose cone opening 245 and pass uphole through the packer plug 200. While the nose cone 240 has been illustrated as having the shape of a cone, other embodiments exist wherein the nose cone 240 has a different shape. For example, the nose cone 240 could have a square base and remain within the scope of the disclosure. Additionally, while a single nose cone opening 245 has been illustrated in FIG. 2, and furthermore that it is positioned in the very tip of the nose cone 240, those skilled in the art understand that any number and location of nose cone openings 245 may be used.

The packer plug 200 additionally includes a check valve 250 positioned uphole of the nose cone opening 245. The check valve 250, in accordance with the disclosure, is configured to allow fluid to pass there through, and thus exit the packer plug 200, when the packer plug 200 is being pushed downhole, but likewise is configured to prevent uphole fluid from entering the packer plug 200 as it is being pushed downhole. One embodiment of the check valve 250, as is shown in FIG. 2, is a ball check valve. The check valve 250 illustrated in FIG. 2 includes a ball check 255 and ball seat 260. The ball check 255, which is a solid ball check that does not leak or weep in this embodiment, is configured to engage the ball seat 260 from an uphole direction. Accordingly, pressure upon the ball check 255 seals the uphole portion of the packer plug 200 from the downhole portion of the packer plug 200. In certain embodiment, such as shown, a compression member 265 such as a spring may be used to maintain an appropriate amount of pressure on the ball check 255.

The check valve 250, in one embodiment, additionally includes a pressure relief apparatus 270. The pressure relief apparatus 270, in the embodiment shown, is coupled downhole of the ball seat 260. The pressure relief apparatus 270, in this embodiment, is configured to prevent a hydraulic lock between the ball check 255 and the lower packer assembly (e.g., including a fluid loss device) located there below, as the service tool assembly is being finally drawn uphole.

The packer plug 200, in the disclosed embodiment, further includes connector mechanism 280. The connector mechanism 280, in one embodiment, is configured to engage a running tool (not shown), and thus allow the packer plug 200 to be deployed downhole, as well as be drawn uphole, using the aforementioned running tool. In the embodiment of FIG. 2, the connector mechanism 280 includes a connector device shear feature 285. The connector device shear feature 285 may be designed to not shear as the packer plug 200 is being deployed downhole, but shear when an appropriate amount of shear force is placed thereon as the packer plug 200 is being drawn uphole. The connector device shear feature 285 may embody many different configurations, but in one embodiment is a simple shear pin.

Figure 3:
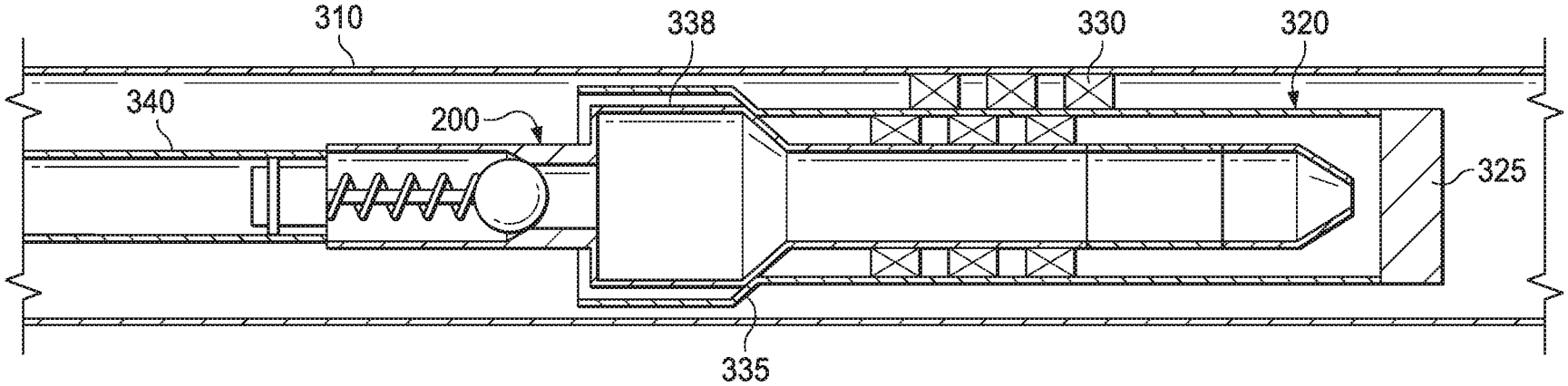
FIG. 3 illustrates the packer plug of FIG. 2 positioned within a lower packer assembly.

Turning briefly to FIG. 3, illustrated is the packer plug 200 of FIG. 2 appropriately placed within a lower packer assembly 320, which in turn has been positioned within a wellbore casing 310. The lower zone packer assembly 320, in this embodiment, includes a fluid loss device 325, as well as casing seals 330. In this embodiment, the casing seals 330 would seal an annulus created between the outer diameter of the lower packer assembly 320 and the inner diameter of the wellbore casing 310. While traditional sump seals are shown as the casing seals 330, those skilled in the art understand that any devices capable of sealing the aforementioned annulus are within the scope of the disclosure.

The lower packer assembly 320 of FIG. 3 additionally includes one or more no go shoulders 335. In the particular embodiment shown in FIG. 3, the no go shoulders 335 are configured to engage the no go feature 215 of the packer plug 200, as the packer plug 200 is being pushed downhole. The packer plug seals 225, in turn, seal an annulus created between the outer diameter of the packer plug 200 and the inner diameter of the lower packer assembly 320.

Additionally, coupled to the connector mechanism 280 of the packer plug 200 is a running tool 340. The running tool 340, in the particular embodiment shown, is engaged with the connector device shear feature 285. For instance, the running tool 340 engages with the connector device shear feature 285 in such a way that little to no shear force is exerted on the connector device shear feature 285 as the packer plug 200 is being pushed downhole, but the connector device shear feature 285 may shear (e.g., and thus release the packer plug 200 from the running tool 340) when an appropriate amount of uphole force is placed thereon. Such a design allows the running tool 340 to shear from the packer plug 200 prior to any perforating and/or fracturing process.

In the illustrated embodiment, and in accordance with the principles of the present disclosure, a downhole portion of the packer plug 200 is stinged into the lower zone packer assembly 320. When the packer plug 200 is stinged into the lower zone packer assembly 320, a packer assembly shear feature 338 locks the packer plug 200 in place within the lower zone packer assembly 320. Those skilled in the art understand the different types of shear features that could be used as the packer assembly shear feature 338. Accordingly, when used in a well system such as the well system 100, the lower fracturing zone 160 would be substantially, if not completely, isolated from the upper fracturing zone 170. At this point (e.g., with the lower fracturing zone 160 substantially isolated from the upper fracturing zone 170) the perforating and/or fracturing of the upper fracturing zone 170 may commence, including using high-pressure fluid and proppants. As discussed above, the check valve 250 is configured to protect the fluid loss device 325 of the lower packer assembly from any compressive forces generated during perforating the wellbore casing 310.

Figure 4A:
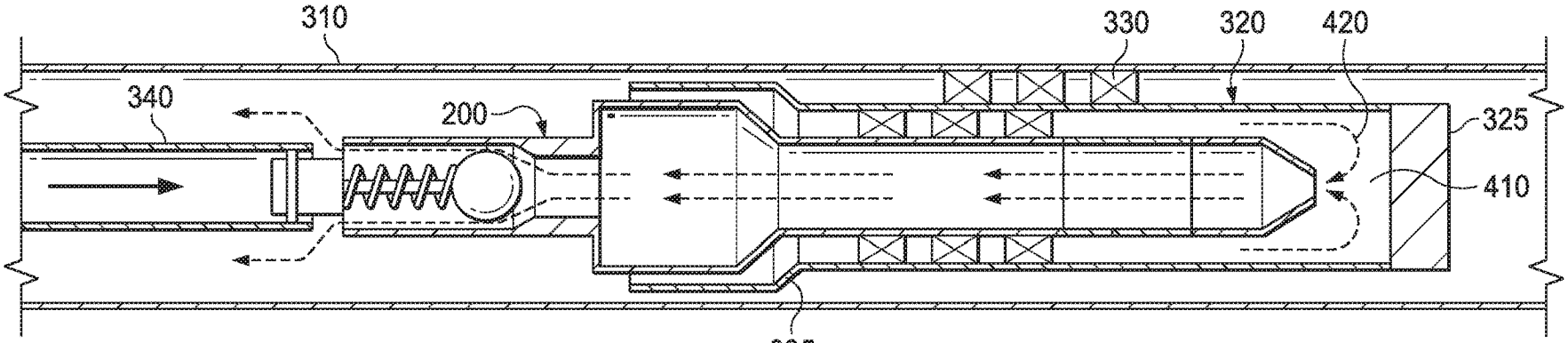
FIGS. 4A and 4B illustrate the packer plug of FIG. 2 as it is being pushed downhole and pulled uphole, respectively.
Figure 4B:
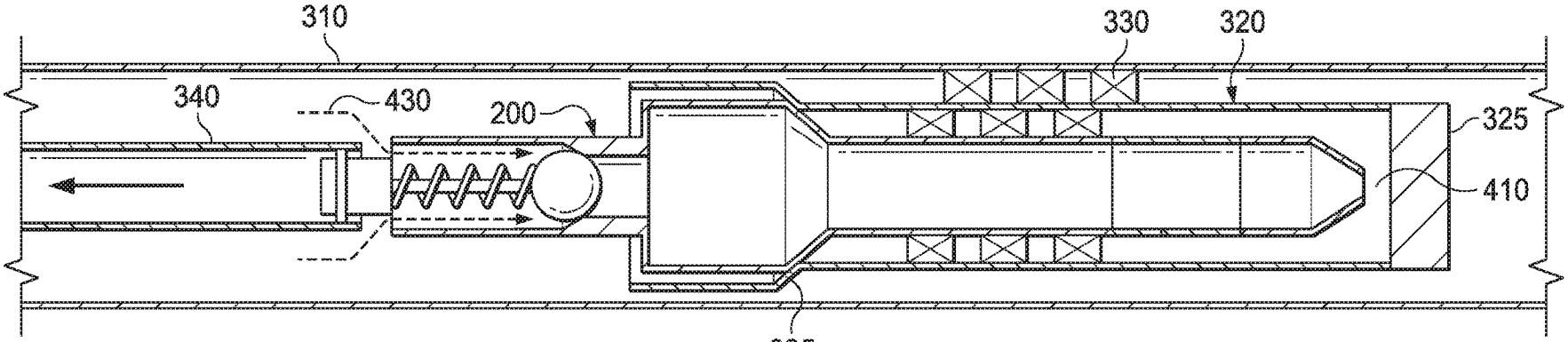

Turning to FIGS. 4A and 4B, illustrated are different views of the packer plug 200 of FIGS. 2 and 3 as it is being pushed downhole and pulled uphole, respectively. As shown in FIG. 4A, when the packer plug 200 is pushed downhole with the running tool 340 (e.g., thereby reducing the space 410 between the uphole portion of the fluid loss device 325 and the lower end of the packer plug 200), excess fluid 420 in the space 410 may be forced through the nose cone opening 245 and interior of the packer plug 200 to unseat the ball check 255 from the ball seat 260 and thus exit the packer plug 200. Accordingly, the no go feature 215 of the packer plug 200 are allowed to engage the no go shoulders 335 of the lower packer assembly 320 as the packer plug 200 is pushed downhole.

In contrast, as shown in FIG. 4B, the check valve 250 prevents excess fluid 430 from entering the space 410 after the packer plug 200 is seated within the lower packer assembly 320. Accordingly, the packer plug 200 may remain seated within the lower packer assembly 320 regardless of any uphole fluid pressure. Specifically, the no go feature 215 of the packer plug 200 remain engaged with the no go shoulders 335 of the lower packer assembly 320 regardless of any uphole fluid pressure.

Figure 5A:
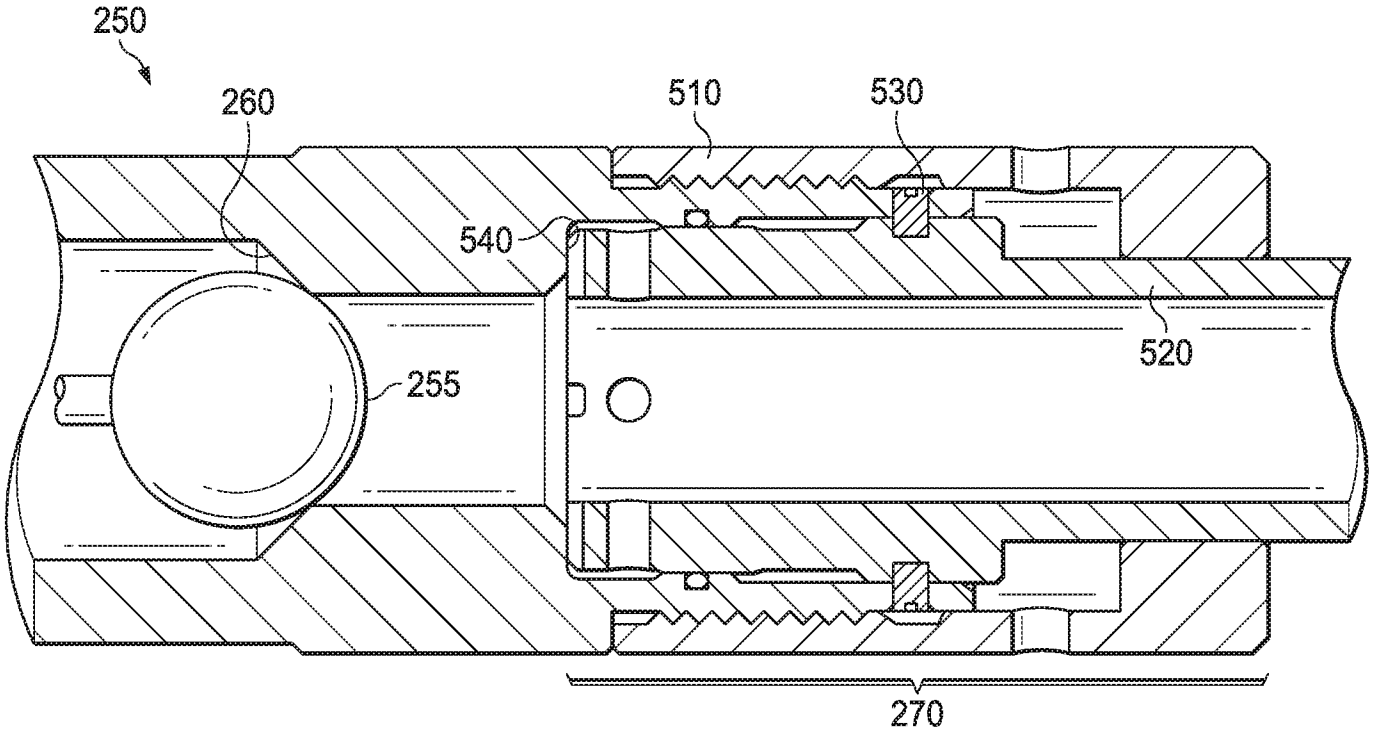
FIGS. 5A and 5B illustrate enlarged renderings of the check valve of FIG. 2 at different operational states.
Figure 5B:
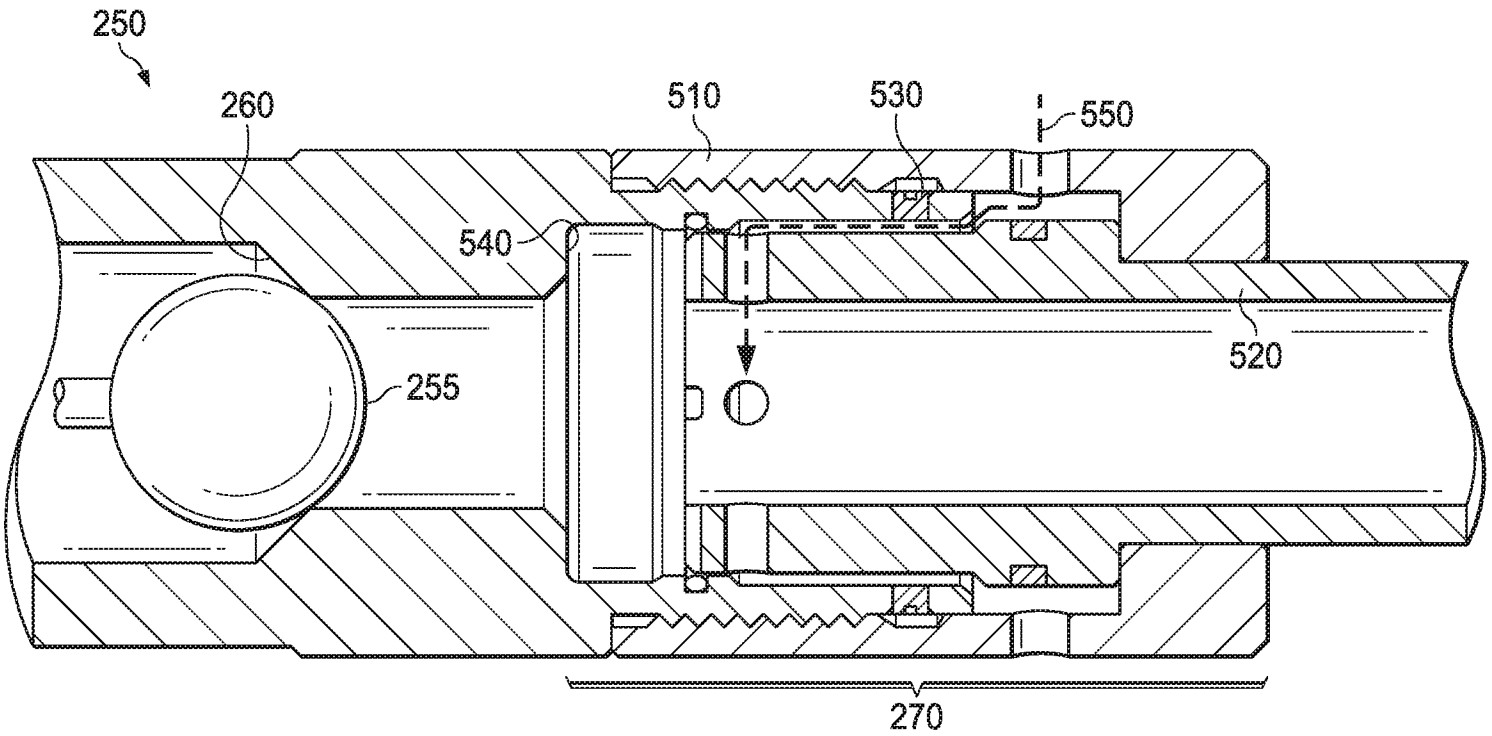

Turning now to FIGS. 5A and 5B, illustrated are enlarged renderings of the ball check 250 as the packer plug 200 is fully seated within the lower packer assembly 320 (e.g., similar to FIG. 4B) and after the packer plug 200 has been drawn uphole after previously being seated within the lower packer assembly 320. The check valve 250 illustrated in FIGS. 5A and 5B includes the downhole pressure relief apparatus 270 coupled downhole of the ball seat 260. The downhole pressure relief apparatus 270, in this embodiment, is configured to prevent a hydraulic lock between the ball check 255 and a fluid loss device located there below, as the packer plug 200 is finally being drawn uphole. The downhole pressure relief apparatus 270, in certain embodiments, may have an uphole pressure relief portion 510, and a downhole pressure relief portion 520 slidingly engaging the uphole pressure relief portion 510.

The downhole pressure relief apparatus 270, in accordance with the disclosure, may further include a pressure relief shear feature 530 (e.g., shear pin in one embodiment) placed between the uphole pressure relief portion 510 and the downhole pressure relief portion 520. The pressure relief shear feature 530, when used, is configured to keep the uphole pressure relief portion 510 and downhole pressure relief portion 520 substantially fixed with respect to one another when the packer plug 200 is seated within the lower packer assembly 320. The pressure relief shear feature 530, however, is configured to shear when the packer plug 200 is being drawn uphole, such as after a perforating and/or fracturing process is complete and the packer plug 200 is being finally withdrawn uphole. In essence, when the packer plug 200 is being pushed downhole, a no go shoulder 540 on the uphole end of the downhole pressure relief portion 520 prevents the pressure relief shear feature 530 from shearing. However, when the packer plug 200 is being drawn uphole, a shear force is placed upon the pressure relief shear feature 530 causing it to shear.

The pressure relief shear feature 530 may comprise a shear pin, shear bolt, shear screw, among other shear feature designs, and remain within the purview of the disclosure. The pressure relief shear feature 530, in accordance with the disclosure, may have a tensile strength less than about ten thousand pounds. In yet another embodiment, the pressure relief shear feature 530 may have a tensile strength ranging from about two thousand pounds to about eight thousand pounds, and in yet another embodiment have a tensile strength of less than about five thousand pounds. Notwithstanding, the pressure relief shear feature 530 should typically have a tensile strength greater than a tensile strength of the connector device shear feature 285. Such a configuration allows the running tool 340 to shear from the connector mechanism 280 while leaving the pressure relief shear feature 530 intact, as might be desired when shearing the running tool 340 from the packer plug 200, but at the same time allowing the pressure relief shear feature 530 to be sheared as the packer plug 200 is finally being withdrawing uphole. Similarly, the packer assembly shear feature 338 should typically have a tensile strength greater than a tensile strength of the pressure relief shear feature 530. Such a configuration allows the running tool 340 to shear from the connector mechanism 280 while leaving the pressure relief shear feature 530 intact, as might be desired when shearing the running tool 340 from the packer plug 200, then allow the pressure relief shear feature 530 to shear while leaving the packer assembly shear feature 338 intact, as might be desired when equalizing the pressure, and last the packer assembly shear feature 338 would shear, thus allowing the packer plug 200 to separate from the lower zone packer assembly 320, and thus be finally drawn uphole.

In accordance with the disclosure, the uphole pressure relief portion 510 and downhole pressure relief portion 520 are slidingly configured to expose a fluid lock path 550 between an interior of the packer plug 200 and an exterior of the packer plug 200 when the pressure relief shear feature 530 shears. Thus, when the packer plug 200 is finally being withdrawn uphole, for example where there is a circumstance for a hydraulic lock downhole, the pressure relief shear feature 530 would shear, substantially equalizing the pressure uphole and downhole. FIG. 5A illustrates the packer plug 200 prior to the pressure relief shear feature 530 shearing, and FIG. 5B illustrates the packer plug 200 after the pressure relief shear feature 530 shearing.

The apparatuses, systems and methods of the present disclosure have many advantages over existing apparatuses, systems and methods. For the example, apparatuses are simple, cost effective, and do not require pinning sheets and calculations to function as designed. Furthermore, such apparatuses require no development work, can be standardized within a given casing and packer bore size, and can be used without adjustments from well to well, and thus redress cost and time between jobs is very minimal. Moreover, bottom hole static pressures of the upper zone do not affect the functionality of the packer plug or the fluid loss device in the lower zone, so a less expensive fluid loss device for a lower zone can be considered. Moreover, the packer plug does not need to be adjusted based on perforating or bottom hole pressures changes. Furthermore, due to the design of the packer plug, a pressure cycle operated fluid loss device (e.g., or a pressure shear operated fluid loss device) below the packer plug does not need additional cycles added or to be shear pinned to a higher value to prevent its premature opening.

Aspects disclosed herein include:

A. A packer plug, the packer plug including: an engagement member having one or more no go features, the no go features of the engagement member configured to engage one or more no go shoulders of an associated packer assembly, a nose cone having one or more nose cone openings coupled proximate a downhole end of the engagement member, and a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole.

B. A well system, the well system including a wellbore penetrating a subterranean formation and forming a lower fracturing zone and an upper fracturing zone, a lower zone packer assembly positioned at least partially within the lower fracturing zone, an upper zone packer assembly positioned at least partially within the upper fracturing zone, the lower zone packer assembly and upper zone packer assembly configured to substantially isolate the lower fracturing zone from the upper fracturing zone, and a packer plug cooperatively engaging the lower zone packer assembly. The packer plug, in this well system, includes an engagement member having one or more no go features, the no go features of the engagement member configured to engage one or more no go shoulders of the lower zone packer assembly, a nose cone having one or more nose cone openings coupled proximate a downhole end of the engagement member, and a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole.

C. A method for completing a well system, the method including forming a wellbore penetrating a subterranean formation, the wellbore including a lower fracturing zone and an upper fracturing zone, positioning a lower zone packer assembly at least partially within the lower fracturing zone, the lower zone packer assembly including a fluid loss device, cooperatively engaging a packer plug with the lower zone packer assembly, and perforating the upper fracturing zone with the packer plug engaged with the lower zone packer assembly. The packer plug, in this method, including an engagement member having one or more no go features, the no go features of the engagement member engaging one or more no go shoulders of the lower zone packer assembly, a nose cone having one or more nose cone openings coupled proximate a downhole end of the engagement member, and a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole.

Aspects A, B and C may have one or more of the following additional elements in combination:

Element 1: wherein the check valve includes a ball check and ball seat, the ball check configured to engage the ball seat from an uphole direction. Element 2: wherein the check valve further includes a compression member configured to maintain an amount of pressure on the ball check from an uphole direction. Element 3: wherein the check valve further includes a downhole pressure relief apparatus coupled downhole of the ball seat, the downhole pressure relief apparatus configured to prevent a hydraulic lock between the ball check and a fluid loss device located there below as the packer plug is being drawn uphole. Element 4: wherein the downhole pressure relief apparatus has an uphole pressure relief portion, and a downhole pressure relief portion slidingly engaging the uphole pressure relief portion. Element 5: further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole. Element 6: wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears. Element 7: further including a connector mechanism including a connector device shear feature coupled proximate an uphole end of the check valve. Element 8: wherein a tensile strength of the pressure relief shear feature is greater than a tensile strength of the connector device shear feature. Element 9: further including a seal assembly coupled to a downhole end of the packer plug, the seal assembly including one or more sump seals. Element 10: wherein the lower zone packer assembly includes a fluid loss device, and further wherein the check valve protects the fluid loss device from pressures generated when subjecting the upper fracturing zone to a perforation process. Element 11: wherein the check valve includes a ball check, a ball seat and a compression member, the ball check configured to engage the ball seat from an uphole direction, and the compression member configured to maintain an amount of pressure on the ball check from an uphole direction. Element 12: wherein the check valve further includes a downhole pressure relief apparatus coupled downhole of the ball seat, the downhole pressure relief apparatus having an uphole pressure relief portion, and a downhole pressure relief portion slidingly engaging the uphole pressure relief portion, and further wherein the downhole pressure relief apparatus is configured to prevent a hydraulic lock between the ball check and a fluid loss device located there below as the packer plug is being drawn uphole. Element 13: further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole. Element 14: wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears. Element 15: further including a connector mechanism including a connector device shear feature coupled proximate an uphole end of the check valve, wherein a tensile strength of the pressure relief shear feature is greater than a tensile strength of the connector device shear feature. Element 16: wherein the check valve includes a ball check, a ball seat and a compression member, the ball check configured to engage the ball seat from an uphole direction, and the compression member configured to maintain an amount of pressure on the ball check from an uphole direction, and wherein the check valve further includes a downhole pressure relief apparatus coupled downhole of the ball seat, the downhole pressure relief apparatus having an uphole pressure relief portion, and a downhole pressure relief portion slidingly engaging the uphole pressure relief portion, and further wherein the downhole pressure relief apparatus is configured to prevent a hydraulic lock between the ball check and a fluid loss device located there below as the packer plug is being drawn uphole. Element 17: further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole. Element 18: wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears, and further including drawing the packer plug uphole after the perforating, the drawing shearing the shear pin to expose the fluid lock path.

Those skilled in the art to which this application relates will appreciate that other and further additions, deletions, substitutions and modifications may be made to the described embodiments.

What is claimed is:

1. A packer plug, comprising:

an engagement member having one or more no go features, the no go features of the engagement member configured to engage one or more no go shoulders of an associated packer assembly;

a nose cone having one or more nose cone openings coupled proximate a downhole end of the engagement member;

a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole; and a downhole pressure relief apparatus downhole of the check valve, the downhole pressure relief apparatus configured to prevent a hydraulic lock between the check valve and the packer assembly.

2. The packer plug as recited in claim 1, wherein the check valve includes a ball check and ball seat, the ball check configured to engage the ball seat from an uphole direction.

3. The packer plug as recited in claim 2, wherein the check valve further includes a compression member configured to maintain an amount of pressure on the ball check from an uphole direction.

4. The packer plug as recited in claim 3, wherein the check valve further includes a downhole pressure relief apparatus coupled downhole of the ball seat, the downhole pressure relief apparatus configured to prevent a hydraulic lock between the ball check and a fluid loss device located there below as the packer plug is being drawn uphole.

5. The packer plug as recited in claim 4, wherein the downhole pressure relief apparatus has an uphole pressure relief portion, and a downhole pressure relief portion slidingly engaging the uphole pressure relief portion.

6. The packer plug as recited in claim 5, further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole.

7. The packer plug as recited in claim 6, wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears.

8. The packer plug as recited in claim 7, further including a connector mechanism including a connector device shear feature coupled proximate an uphole end of the check valve.

9. The packer plug as recited in claim 8, wherein a tensile strength of the pressure relief shear feature is greater than a tensile strength of the connector device shear feature.

10. The packer plug as recited in claim 1, further including a seal assembly coupled to a downhole end of the packer plug, the seal assembly including one or more sump seals.

11. The packer plug as recited in claim 1, wherein the check valve is located uphole of the one or more no go features.

12. The packer plug as recited in claim 1, wherein the check valve is located uphole of the engagement member.

13. A well system, comprising:

a wellbore penetrating a subterranean formation and forming a lower fracturing zone and an upper fracturing zone;

a lower zone packer assembly positioned at least partially within the lower fracturing zone;

an upper zone packer assembly positioned at least partially within the upper fracturing zone, the lower zone packer assembly and upper zone packer assembly configured to substantially isolate the lower fracturing zone from the upper fracturing zone;

a packer plug cooperatively engaging the lower zone packer assembly, the packer plug including;

an engagement member having one or more no go features, the no go features of the engagement member configured to engage one or more no go shoulders of the lower zone packer assembly;

a nose cone having one or more nose cone openings coupled proximate a downhole end of the engagement member;

a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole; and a downhole pressure relief apparatus downhole of the check valve, the downhole pressure relief apparatus configured to prevent a hydraulic lock between the check valve and the packer assembly.

14. The well system as recited in claim 13, wherein the lower zone packer assembly includes a fluid loss device, and further wherein the check valve protects the fluid loss device from pressures generated when subjecting the upper fracturing zone to a perforation process.

15. The well system as recited in claim 13, wherein the check valve includes a ball check, a ball seat and a compression member, the ball check configured to engage the ball seat from an uphole direction, and the compression member configured to maintain an amount of pressure on the ball check from an uphole direction.

16. The well system as recited in claim 15, wherein the check valve further includes a downhole pressure relief apparatus coupled downhole of the ball seat, the downhole pressure relief apparatus having an uphole pressure relief portion, and a downhole pressure relief portion slidingly engaging the uphole pressure relief portion, and further wherein the downhole pressure relief apparatus is configured to prevent a hydraulic lock between the ball check and a fluid loss device located there below as the packer plug is being drawn uphole.

17. The well system as recited in claim 16, further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole.

18. The well system as recited in claim 17, wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears.

19. The well system as recited in claim 18, further including a connector mechanism including a connector device shear feature coupled proximate an uphole end of the check valve, wherein a tensile strength of the pressure relief shear feature is greater than a tensile strength of the connector device shear feature.

20. A method for completing a well system, comprising:

forming a wellbore penetrating a subterranean formation, the wellbore including a lower fracturing zone and an upper fracturing zone;

positioning a lower zone packer assembly at least partially within the lower fracturing zone, the lower zone packer assembly including a fluid loss device;

cooperatively engaging a packer plug with the lower zone packer assembly, the packer plug including;

an engagement member having one or more no go features, the no go features of the engagement member engaging one or more no go shoulders of the lower zone packer assembly;

a nose cone having one or more nose cone openings coupled proximate a downhole end of the engagement member;

a check valve coupled proximate the engagement member, the check valve, engagement member, and nose cone creating a fluid path between a lower end of the packer plug and an upper end of the packer plug, and further wherein the check valve is configured to allow downhole fluid to pass uphole through the fluid path as the packer plug is being pushed downhole, but substantially prevent uphole fluid from passing downhole through the fluid path as the packer plug is being pulled uphole; and a downhole pressure relief apparatus downhole of the check valve, the downhole pressure relief apparatus configured to prevent a hydraulic lock between the check valve and the packer assembly; and perforating the upper fracturing zone with the packer plug engaged with the lower zone packer assembly.

21. The method as recited in claim 20, wherein the check valve includes a ball check, a ball seat and a compression member, the ball check configured to engage the ball seat from an uphole direction, and the compression member configured to maintain an amount of pressure on the ball check from an uphole direction, and wherein the check valve further includes a downhole pressure relief apparatus coupled downhole of the ball seat, the downhole pressure relief apparatus having an uphole pressure relief portion, and a downhole pressure relief portion slidingly engaging the uphole pressure relief portion, and further wherein the downhole pressure relief apparatus is configured to prevent a hydraulic lock between the ball check and a fluid loss device located there below as the packer plug is being drawn uphole.

22. The method as recited in claim 21, further including a pressure relief shear feature placed between the uphole pressure relief portion and the downhole pressure relief portion, the pressure relief shear feature configured to keep the uphole pressure relief portion and downhole pressure relief portion substantially fixed with respect to one another when the packer plug is being pushed downhole, but configured to shear when the packer plug is being drawn uphole.

23. The method as recited in claim 22, wherein the pressure relief shear feature is a shear pin, and further wherein the uphole pressure relief portion and downhole pressure relief portion are slidingly configured to expose a fluid lock path between an interior of the packer plug and an exterior of the packer plug when the shear pin shears, and further including drawing the packer plug uphole after the perforating, the drawing shearing the shear pin to expose the fluid lock path.

* * * * *